United States Patent [19]

Persson et al.

[11] Patent Number: 4,630,854

[45] Date of Patent: Dec. 23, 1986

[54] SECURITY DEVICE

[76] Inventors: Tor Persson; Gerthy Persson, both of 594 Goddard Road, R.R. 1, Nelson, British Columbia, Canada, V1L 5P4

[21] Appl. No.: 771,323

[22] Filed: Aug. 30, 1985

[51] Int. Cl.[4] ..... E05C 17/54

[52] U.S. Cl. ..... 292/343

[58] Field of Search ..... 292/258, 288, 342, 343, 292/DIG. 46

[56] References Cited

U.S. PATENT DOCUMENTS

| | | | |
|---|---|---|---|
| 777,099 | 12/1904 | Hillyard | 292/60 |
| 941,885 | 11/1909 | LaBair | 292/343 |
| 1,154,148 | 9/1915 | West | 292/343 |
| 1,922,298 | 8/1933 | Jones | 292/342 |
| 3,833,963 | 9/1974 | Waters | 292/343 |
| 4,208,841 | 6/1980 | Storks | 292/343 |

*Primary Examiner*—Richard E. Moore

*Attorney, Agent, or Firm*—Townsend & Townsend

[57] ABSTRACT

A security device. The device has a wedge to contact a door to prevent opening the door. An anchor is attached adjacent the door. A slot in the anchor is of predetermined length and width. A catch on the wedge has a limb extending from the wedge with a hook on the limb, remote from the wedge. The hook has a length and width less than the length and width of the slot in the anchor. To prevent opening of the door, the hook is engaged in the slot. Release of the wedge to enable opening of the door is achieved by moving the wedge so the hook portion lies along the slot and can be removed through the slot.

4 Claims, 2 Drawing Figures

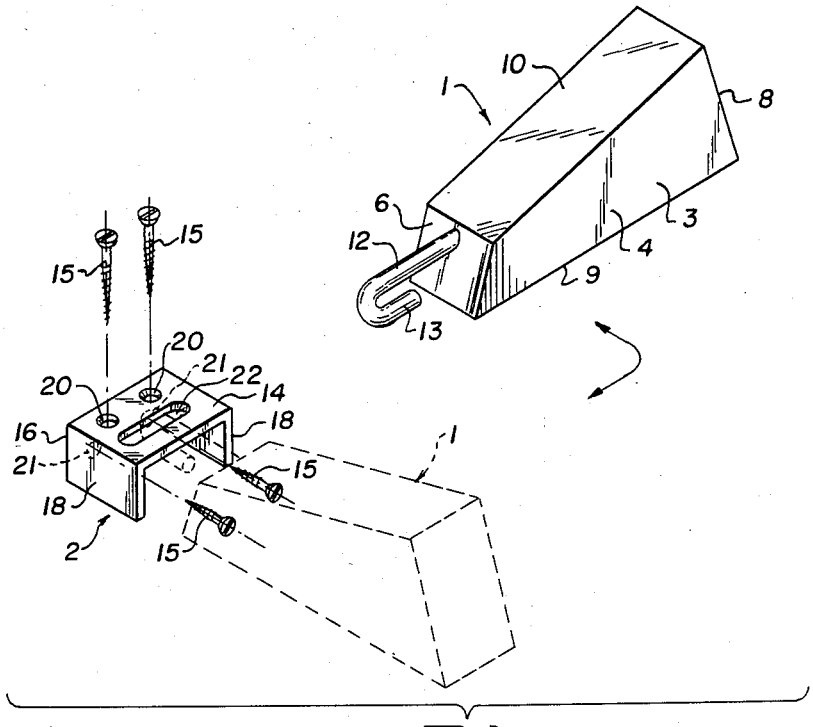
Fig. 1.
Fig. 2.
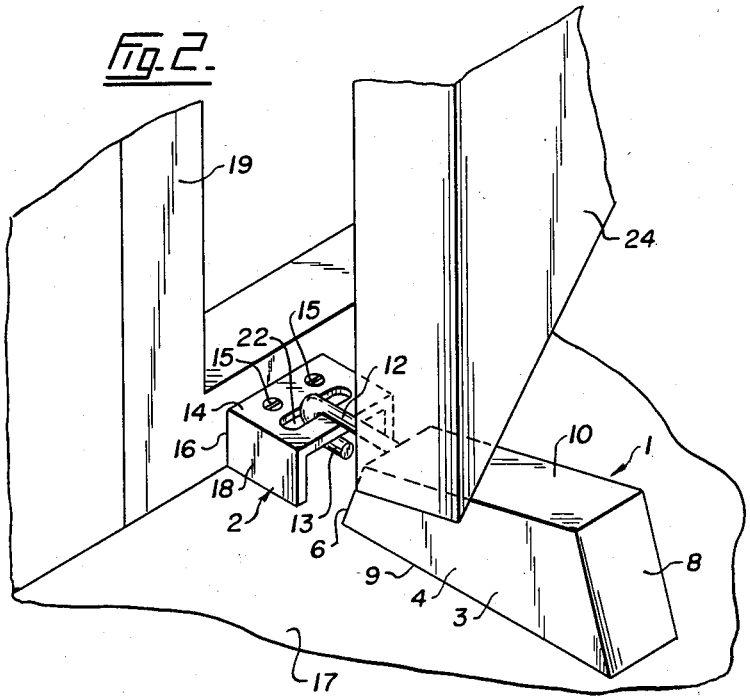

SECURITY DEVICE

FIELD OF THE INVENTION

This invention relates to a security device, more particularly a security device that prevents forced entry through a door.

DESCRIPTION OF THE PRIOR ART

Dead bolt locks are currently recognized as the safest means of preventing unlawful entry into a house, apartment, office or the like. While these devices are excellent for protecting valuables within the house when no-one is present there are disadvantages in their use when one is alone at home and wishes to answer the door. With a conventional solid door, the door must be opened and thus unlocked for the occupant to observe the caller. This can compromise the security of the occupant as forceful entry by a stranger could be accomplished with relative ease.

In attempts to remedy this problem peepholes and small windows have been incorporated in many door structures so that the caller may be viewed by the occupant before the door is unlocked. However retrofitting a conventional door can prove time-consuming and expensive. Furthermore the view through the windows provided are often so distorted as to make people unrecognizable. Communication through the door can be difficult.

A popular security means has been the attachment of small chains and latches to the inner door frame and door. These allow the occupant to open the door slightly to allow him to view and communicate with the caller but the door is not opened wide enough to allow the passage of the caller. Unfortunately many mountings of these devices are such they can be easily torn from their moorings if enough force is applied when the door is opened by the small amount necessary to view the caller.

SUMMARY OF THE INVENTION

The present invention seeks to provide a durable yet simple and inexpensive security device for use with doors that enables the occupant of the house to view and communicate with the caller by partially opening the door but does not compromise the security of the occupant in the process.

Accordingly the present invention provides a security device comprising a wedge to contact a door to prevent opening the door; an anchor to be attached adjacent the door; a slot in the anchor of predetermined length and width; a catch member attached to the wedge and comprising a limb extending from the wedge with a hook on the limb, remote from the wedge, the hook having a length and width less than said predetermined length and width; whereby to prevent opening of the door, the hook is engaged in the slot, with the hook and the limb lying widthwise of the slot, release of the wedge to enable opening of the door being achieved by moving the wedge so the hook portion lies along the slot and can be removed through the slot.

DRAWINGS

Aspects of the invention are illustrated, merely by way of example, in the accompanying drawings in which:

FIG. 1 is a view showing the components of the security device of the present invention; and FIG. 2 shows the device in its useful position.

DESCRIPTION OF THE PREFERRED EMBODIMENTS

The security device of the present invention comprises a wedge 1 and mounting bracket 2. The wedge 1 comprises a one piece block 3 having sides 4, front 6, back 8, bottom 9 and downwardly sloping top 10. The block is preferably formed from wood or the like in order to ensure durability with ease of manufacture. A hook 12 is threadably received in the front 6 of wedge 2 and has rearwardly facing portion 13.

The bracket 2 comprises a rectangular metal plate having a top 14, back 16 and sides 18. A pair of countersunk circular openings 20 are formed in top 14 to allow the bracket to be fixed rigidly to floor 17 by screws 15. Similarly a pair of openings 21 are formed in the back 16 of bracket 2 so that the bracket may also be fixed to door frame 19. An elongated slot 22 is formed in top 14, beside openings 20. The slot 22 is slightly longer than the rearwardly facing portion 13 of hook 12 so that portion 13, when aligned lengthwise over slot 22, is easily received or removed from the slot.

The device is used as follows. Bracket 2 is rigidly secured by screws 15 to the bottom step of a door frame 19 on the inside of a house. Bracket 2 is preferably positioned near the opening edge of the door 24. It is also desirable that a gap approximately equal in height to the diameter of the shank of the screw 12 exists above bracket 2 for reasons discussed below.

Wedge 1 is placed in line with bracket 2 so that portion 13 of hook 12 is received within slot 22 of the bracket 2. A 90° twist of wedge 1 then traps wedge 1 in place as shown in solid lines in FIG. 2 and restricts its movement within the confines of the length of slot 22. In this useful position it will be noted that any attempted opening the door 24 wider than the small crack will cause the base of the door 24 to abut top 10 of wedge 2. As wedge 2 is retained in position by hook 12 and the frictional force between the bottom of the door 1 and the floor 17, the door 24 only need travel a small way on top 10 of the wedge before becoming jammed. This therefore prevents forceful entry and impedes the access of an intruder.

It should be noted that the gap between the top of the door frame 19 and the top of the bracket 2, mentioned previously, ensures that the full force of any attempt to open door 24 is borne by wedge 1 and not the upper surface of hook 12.

To remove the device the wedge 1 is rotated through 90°, to the solid line position as shown in FIG. 1, and lifted upwardly. This procedure can, of course, only be completed when the door 24 is completely shut and only by a person on the inside.

Thus the present invention shows a simple yet efficient means of preventing illegal access to a house, apartment or indeed, through any door.

We claim:

1. A security device comprising:

a wedge to contact a door to restrict opening of the door, the wedge including a first end and a second end and an upper surface, the upper surface sloping upwardly from the first end to the second end;

an anchor to be attached adjacent the door;

a slot in the anchor of predetermined length and width, the slot being generally aligned parallel to the door when attached adjacent the door;

a catch member attached to the wedge and comprising a limb extending longitudinally outwardly from the first end of the wedge with a hook on the limb, remote from the wedge, the hook having a length and width less than said predetermined length and width; whereby to restrict opening of the door, the hook is engaged in the slot, with the hook and the limb lying widthwise of the slot, release of the wedge to enable opening of the door being achieved by moving the wedge so the hook portion lies along the slot and can be removed through the slot.

2. A device as claimed in claim 1 in which the anchor engages a doorstep.

3. A device as claimed in claim 1 in which the anchor has upper plate surface with the slot formed in the upper surface.

4. A device as claimed in claim 1 in which the anchor includes side walls to prevent tampering.

* * * * *